United States Patent [19]

Liu

[11] Patent Number: 5,050,420

[45] Date of Patent: Sep. 24, 1991

[54] MULTI-FUNCTIONAL RIVETER

[76] Inventor: Yang-Ting Liu, No. 23-25-5, Cheng Kung Rd.,, Taipin Hsiang, Taichung Hsien, Taiwan

[21] Appl. No.: 574,134

[22] Filed: Aug. 29, 1990

[51] Int. Cl.[5] ..... B21J 15/04; B21J 15/38

[52] U.S. Cl. ..... 72/391.4; 72/391.8; 29/243.521; 29/243.527

[58] Field of Search ..... 72/391.2, 391.4; 29/243.527, 243.528, 243.529; 227/146

[56] References Cited

U.S. PATENT DOCUMENTS

| | | | |
|---|---|---|---|
| 2,923,938 | 2/1960 | Rinehardt | 227/146 |
| 3,328,985 | 7/1967 | Keymer | 29/243.528 |
| 3,842,649 | 10/1974 | Di Maio | 29/243.528 |
| 4,353,239 | 10/1982 | Fujimoto | 29/243.528 |
| 4,625,538 | 12/1986 | Malagnoux | 72/391.2 |
| 4,643,345 | 2/1987 | Knispel et al. | 227/146 |
| 4,649,732 | 3/1987 | Molina | 29/243.529 |

FOREIGN PATENT DOCUMENTS

| | | | |
|---|---|---|---|
| 1213968 | 4/1960 | France | 227/146 |

*Primary Examiner*—David Jones

*Attorney, Agent, or Firm*—Morton J. Rosenberg; David I. Klein

[57] ABSTRACT

The present invention relates to a multi-functional riveter, whose basic structural components include a body and a body head having a hollow upper portion with an extended hand grip. Located within the interior of the body head is a lever hinged thereto. The one end of the lever is connected to a transmission shaft which, in turn, is attached to a press handle extended and exposed to the outside of the body. The other end of the lever is coupled with a sleeve. The basic structures mentioned above are all indispensable parts of a riveter layout. The functional enhancement and improvement embodied in the present invention are based on specific mechanical arrangements designed to allow a rivet-pulling apparatus, a nut-pulling apparatus, and an anchor rivet apparatus to be integrally disposed within a riveter through its sleeve, resulting in a convenient and multi-functional riveter with the characteristics of a structural simplicity, among other things.

1 Claim, 10 Drawing Sheets

MULTI-FUNCTIONAL RIVETER

BACKGROUND OF THE INVENTION

The present invention relates to an improved riveter, and particularly to an improved riveter of the type designed to perform multiple functions.

The riveter, an indispensable hand tool commonly used by workers in various industries including ornamentalists, is a piece of hand tool made of two basic flat components coupled together and capable of pulling rivets and nails. In other words, a riveter is equipped with a device capable of causing a nail-pulling central rod thereof to move backward.

There is a so-called nut-pulling tool capable of fastening a pulling nut 10 (as shown in FIG. 1) to a metal lamella and making a screw hole 11 in a metal lamella, facilitating a means to connect a metal lamella with something desired. The nut-pulling tool has a capacity to induce a pulling nut to move backward.

As shown in FIG. 2, this is a so-called anchor rivet 20, which can be inlaid in a wooden board by means of an anchor riveter capable of pulling the screw rod 21 of an anchor rivet 20 backward (as shown in FIG. 2A). Due to the fact that an anchor rivet 20 often fails to attach to a wooden board during the first attempt, repetitive attempts are called for generally. Upon the completion of the task of fastening an anchor rivet 20 to a wooden board, the screw rod 21 of the anchor rivet 20 can be removed, resulting in a screw hole formed in the wooden board.

The riveter, the nut-pulling tool, and the anchor riveter mentioned above are all commonly used hand tools having their own exclusive designs and working purposes. Therefore, one must purchase these tools separately. From the standpoint of economy and the cumbersome task of having to carry three different tools during work, the advantages of the present invention, incorporating these three different tools into one, become apparent. In other words, the primary objective of the present invention is to provide an improved riveter of the type designed to perform multiple functions.

SUMMARY OF THE PRESENT INVENTION

The present invention relates to a multi-functional riveter, whose basic structural components include a body and a body head having a hollow upper portion with an extended hand grip. Located within the interior of the body head is a lever hinged thereto. The one end of the lever is connected to a transmission shaft which, in turn, is attached to a press handle extended and exposed to the outside of the body. The basic structures mentioned above are all indispensable parts of a riveter layout. The functional enhancement and improvement embodied in the present invention are based on specific mechanical arrangements designed to allow a rivet-pulling apparatus, a nut-pulling apparatus, and an anchor riveter to be integrally disposed within a riveter through its sleeve, resulting in a convenient and multi-functional riveter with the characteristics of a structural simplicity, economy, among other things.

DESCRIPTION OF THE PREFERRED EMBODIMENT

Figure 2A:
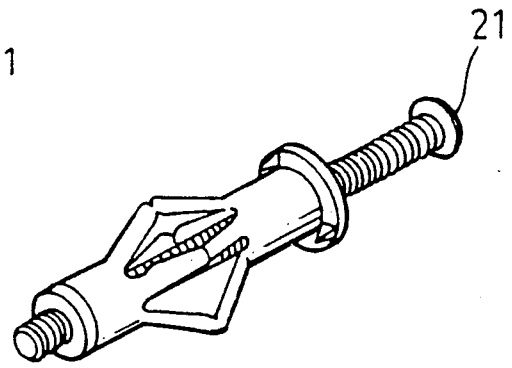
FIG. 2A shows an external view of an anchor rivet with its screw rod being pulled out.
Figure 2:
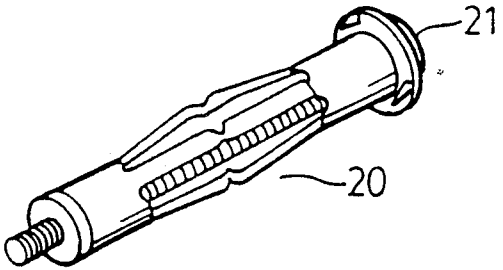
FIG. 2 shows an external view of an anchor rivet.
Figure 1:
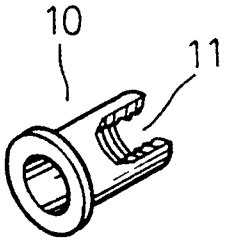
FIG. 1 shows an external view of a pull nut.
Figure 3:
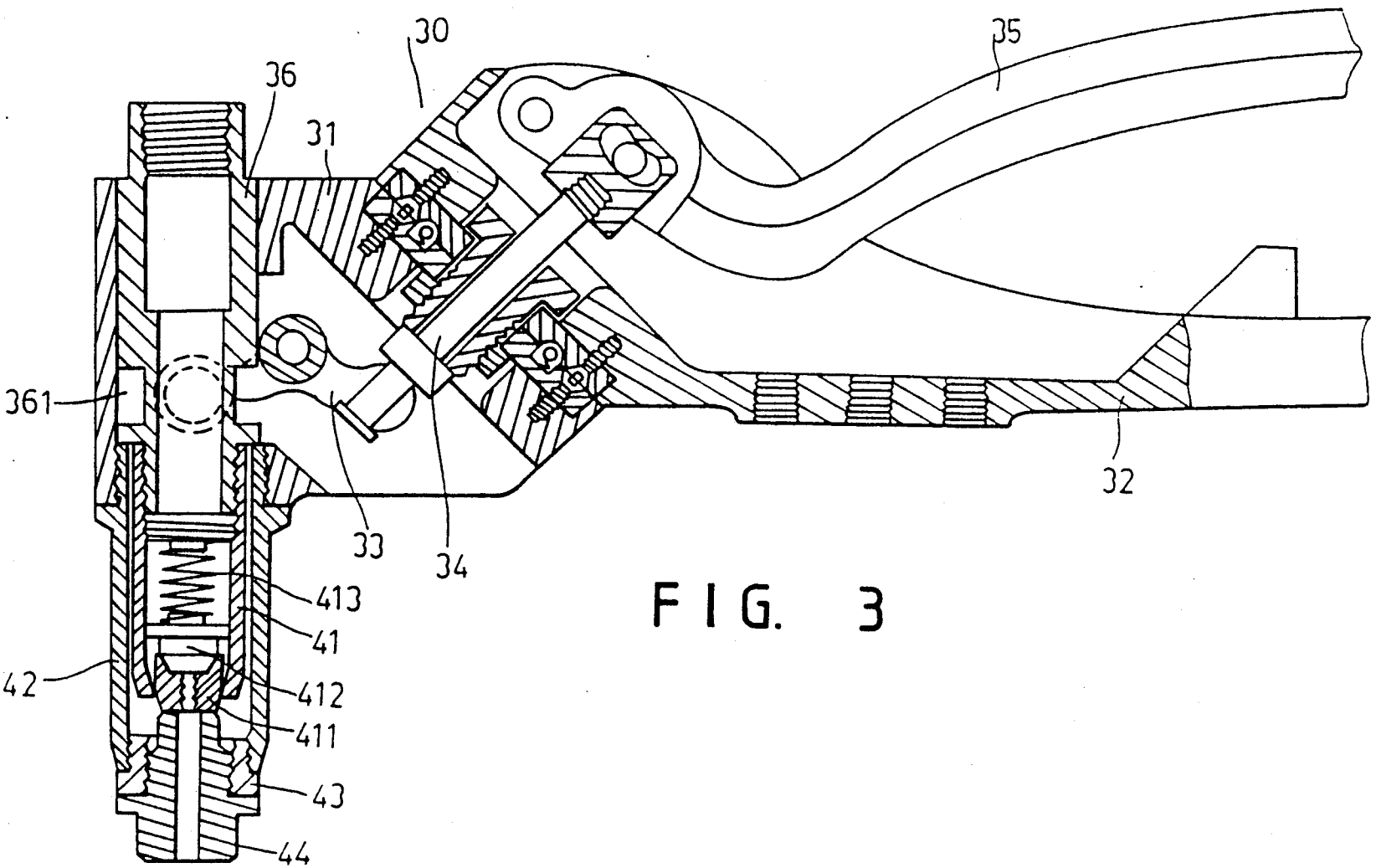
FIG. 3 shows a cut-away view of a riveting apparatus being disposed within the body of a riveter, according to the present invention.
Figure 4:
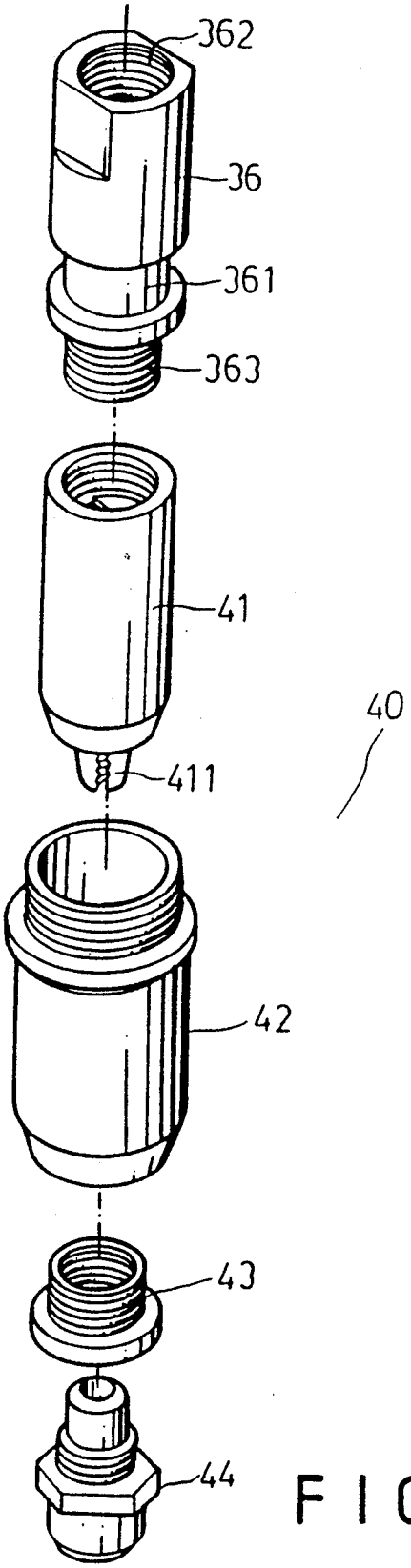
FIG. 4 shows a three-dimensional view of a disassembled riveting apparatus according to the present invention.

Referring to FIGS. 3 and 4, the embodiment of the present invention includes basic structures such as a body 30, a hollow body head 31 located at the upper portion of the body 30, and a hand grip 32 which is an extension of the body head 31. The interior of the body head 31 has a lever 33 hinged thereto. One end of the lever 33 is connected to a transmission shaft 34 which, in turn, is attached to a press handle 35 extended to the outside of the body 30; the other end of the lever 33 is coupled with a sleeve 36 having an inner screw thread 362 disposed therein and an outer screw thread 363 disposed at base portion thereof. The structures mentioned above are fundamentally indispensable as far as the embodiment of the present invention is concerned. When the press handle 35 is pressed down, the lever 33 is triggered to activate the sleeve 36, which will slide upward and downward.

Figure 9:
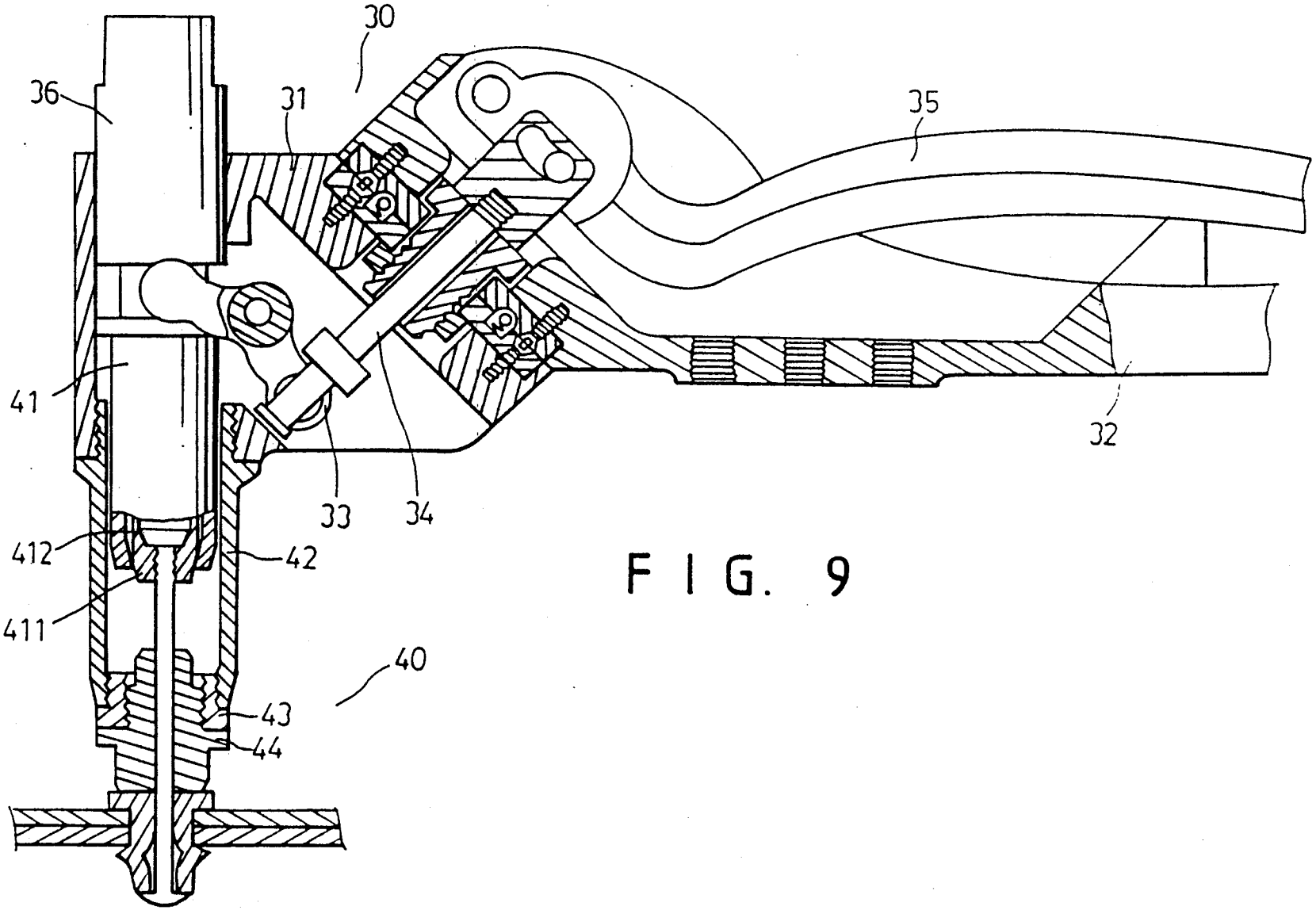
FIG. 9 shows a view of a rivet-pulling apparatus in action.

A rivet-pulling apparatus 40 consists of a rivet holding tube 41 disposed, together with a sleeve 36, within the body head 31. The interior of the rivet holding tube 41 has two conical blocks 411, one press block 412 and a coiled spring 413. The function of the conical blocks 411 is to hold a central rod of a rivet. Located at the base area of the body head 31 is an outer sleeve head 42 which is screwed to a fixed screw nut 43 and a sleeve ear 44 respectively. The sleeve ear 44 is replaceable in accordance with the outer diameter of a rivet being pulled. As soon as the press handle 35 is pressed down, the rivet holding tube 41 will be activated to move backward in order to pull the rivet 70, as shown in FIG. 9.

Figure 5:
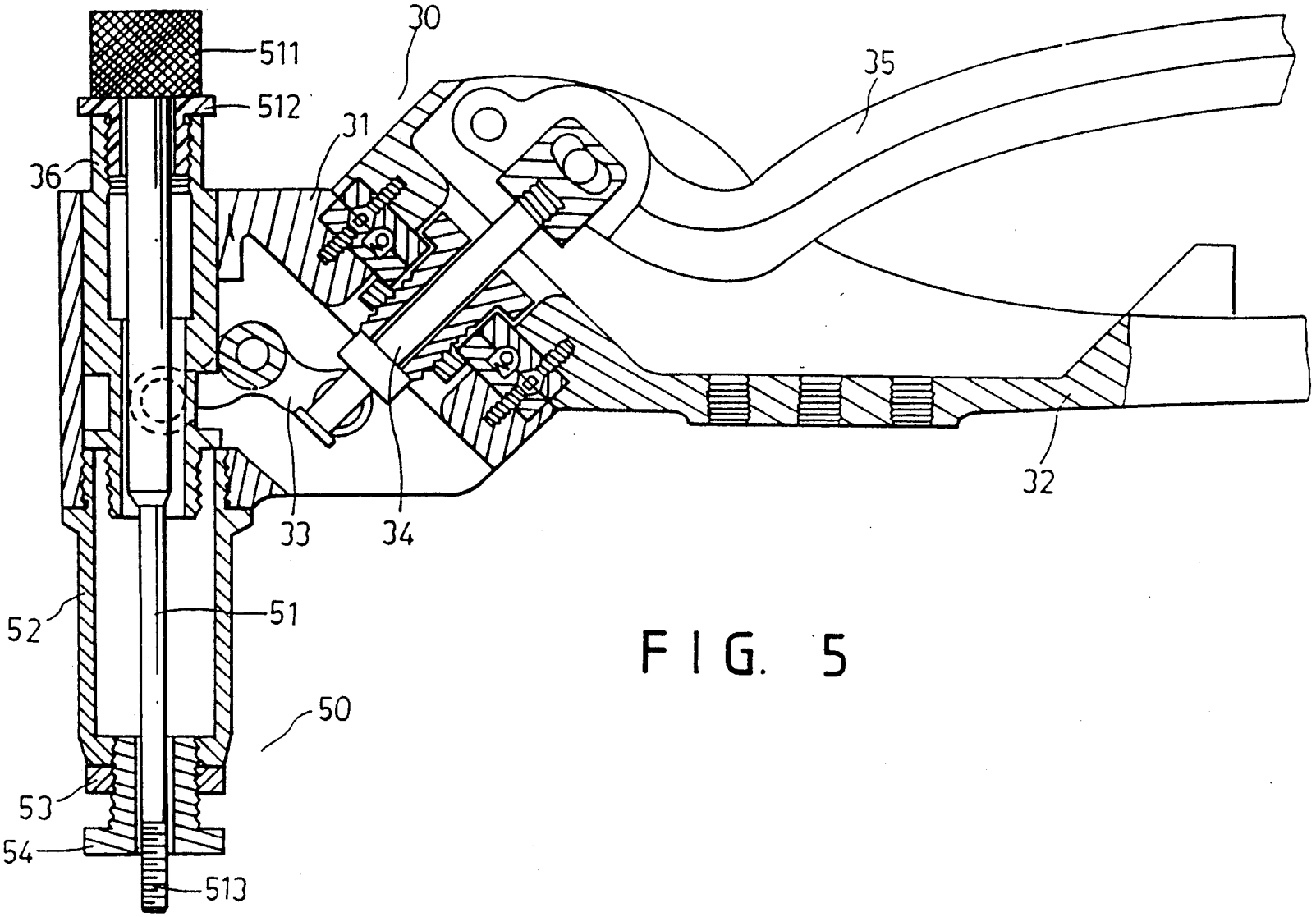
FIG. 5 shows a cut-away view of the embodiment of the present invention, in which a nut-pulling apparatus is disposed.
Figure 6:
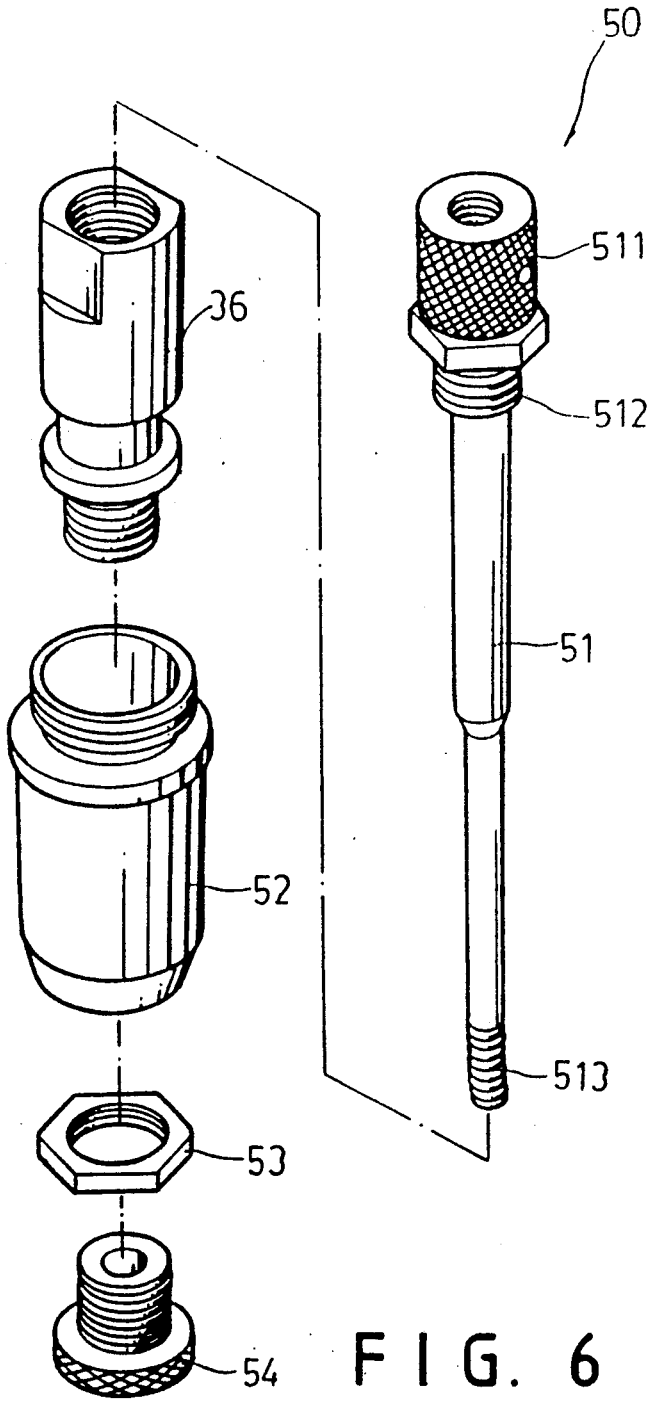
FIG. 6 shows a three-dimensional view of a disassembled nut-pulling apparatus according to the present invention.
Figure 10:
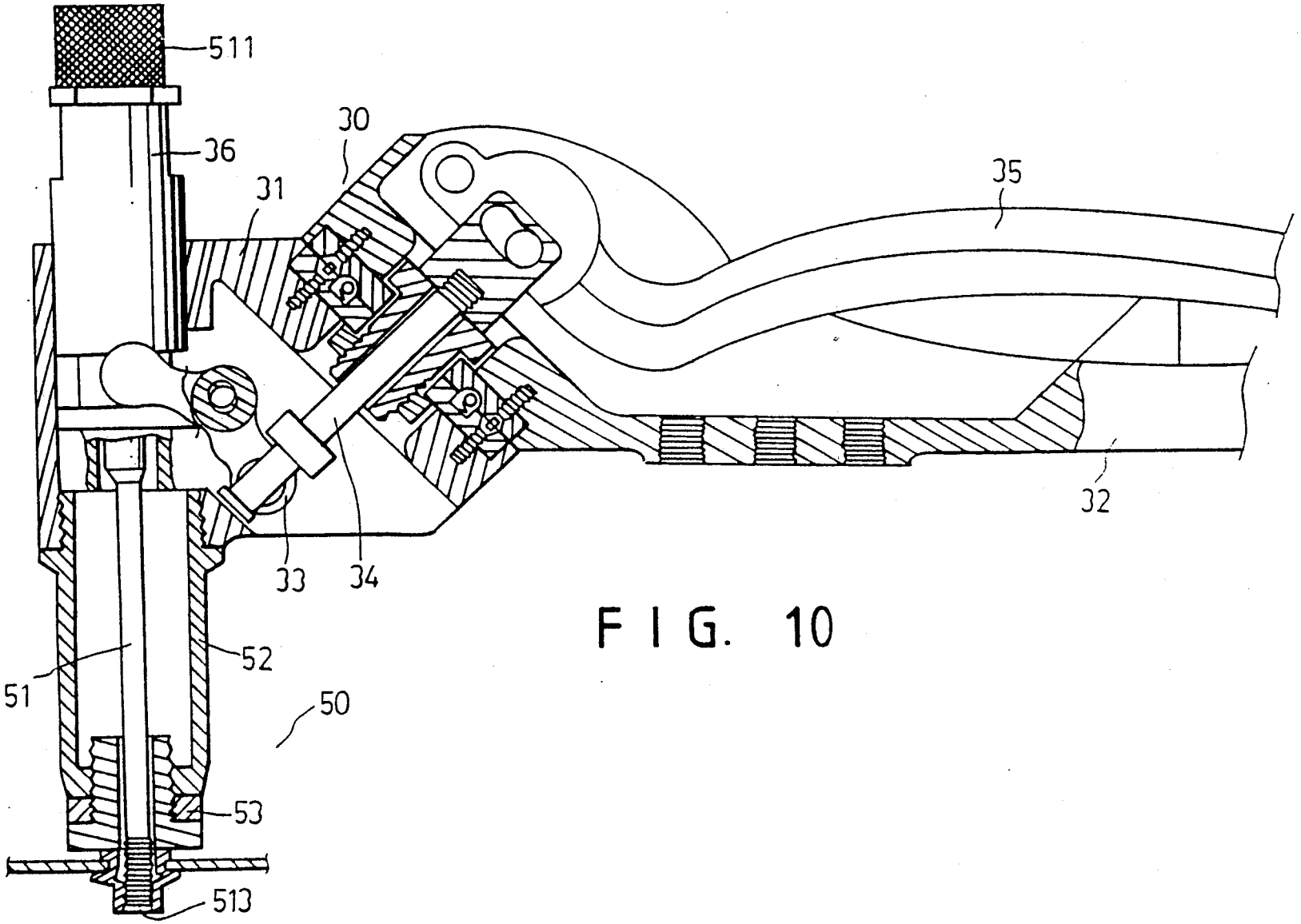
FIG. 10 shows a view of a nut-pulling apparatus in action.

The rivet-pulling apparatus 40 can be dislodged and replaced with a nut-pulling apparatus or an anchor riveting apparatus as desired. As a result of removal of the rivet-pulling apparatus 40, only the sleeve 36 remains inside the body head 31. As shown in FIGS. 5 and 6, a nut-pulling apparatus 50 is disposed in the riveter. The pulling rod 51 of the nut-pulling apparatus 50 is lodged deeply into the sleeve 36. The top end portion of the pulling rod 51 constitutes a press head 511, which is rotatable within outer screw tube 512 by which the nut-pulling apparatus 50 is fastened to the sleeve 36. The base end of the pulling rod 51 constitutes an outer screw thread 513. The body head 31 is fastened to an outer sleeve head 52 extending to the outside thereof. The outer sleeve head 52 is, in turn, fastened to an adjustable screw 54 having a set screw nut 53 disposed thereon. The extent to which the outer screw thread 513 of the pulling rod 51 must be exposed can be adjusted by means of the adjustable screw 54. A nut-pulling apparatus can be attached to the base end of pulling rod 51. Once the press handle 35 in pressed down, the pulling rod 51 will be activated to move upward (backward), as shown in FIG. 10, and thereby force the pulling nut to be firmly attached to the metal lamella. By rotating the press head 511 of the pulling rod 51, the nut-pulling apparatus will become disengaged with the pulling nut, and thus the job is completed.

Figure 7:
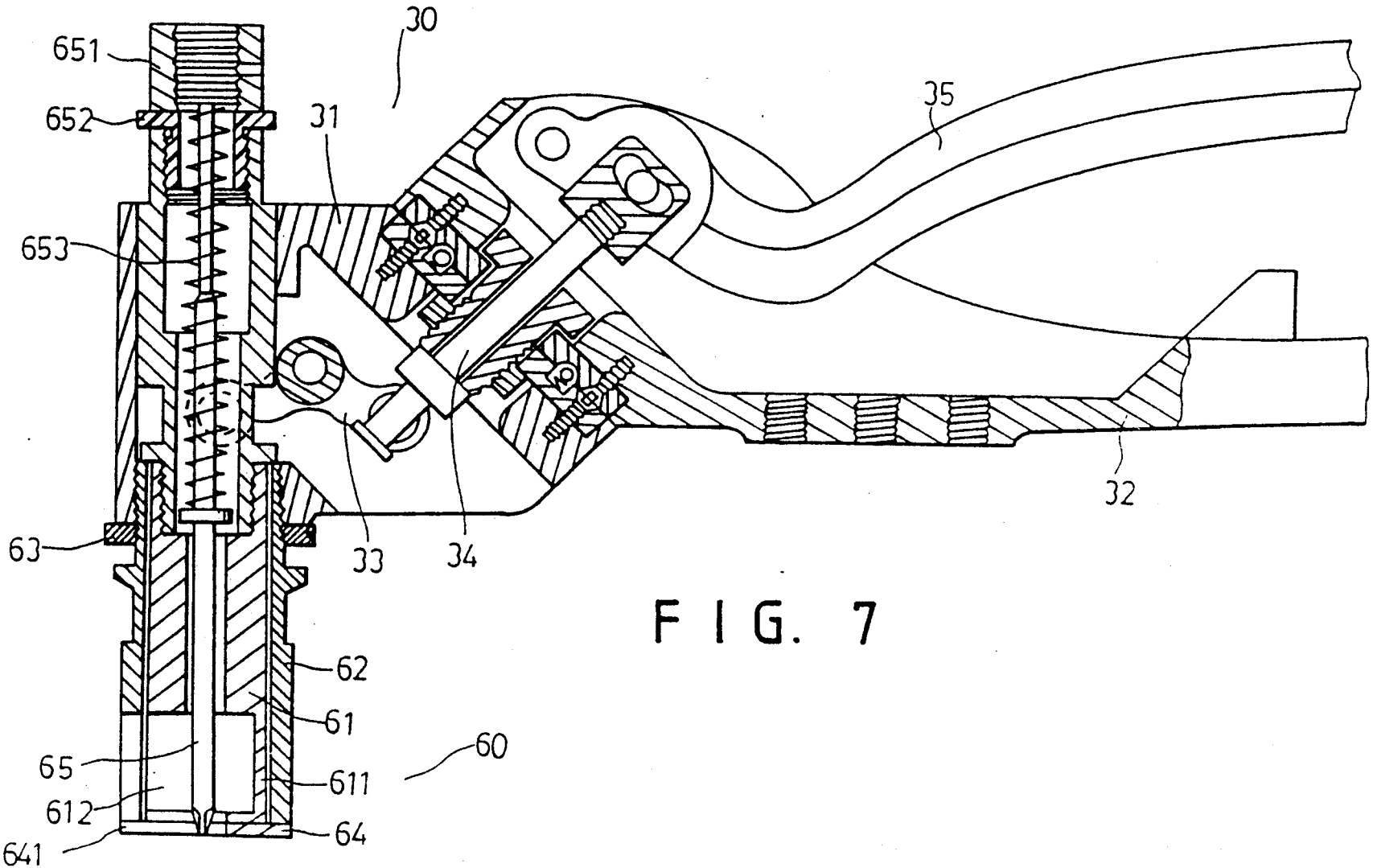
FIG. 7 shows a cut-away view of the embodiment of the present invention, in which an anchor riveting apparatus is disposed.
Figure 8:
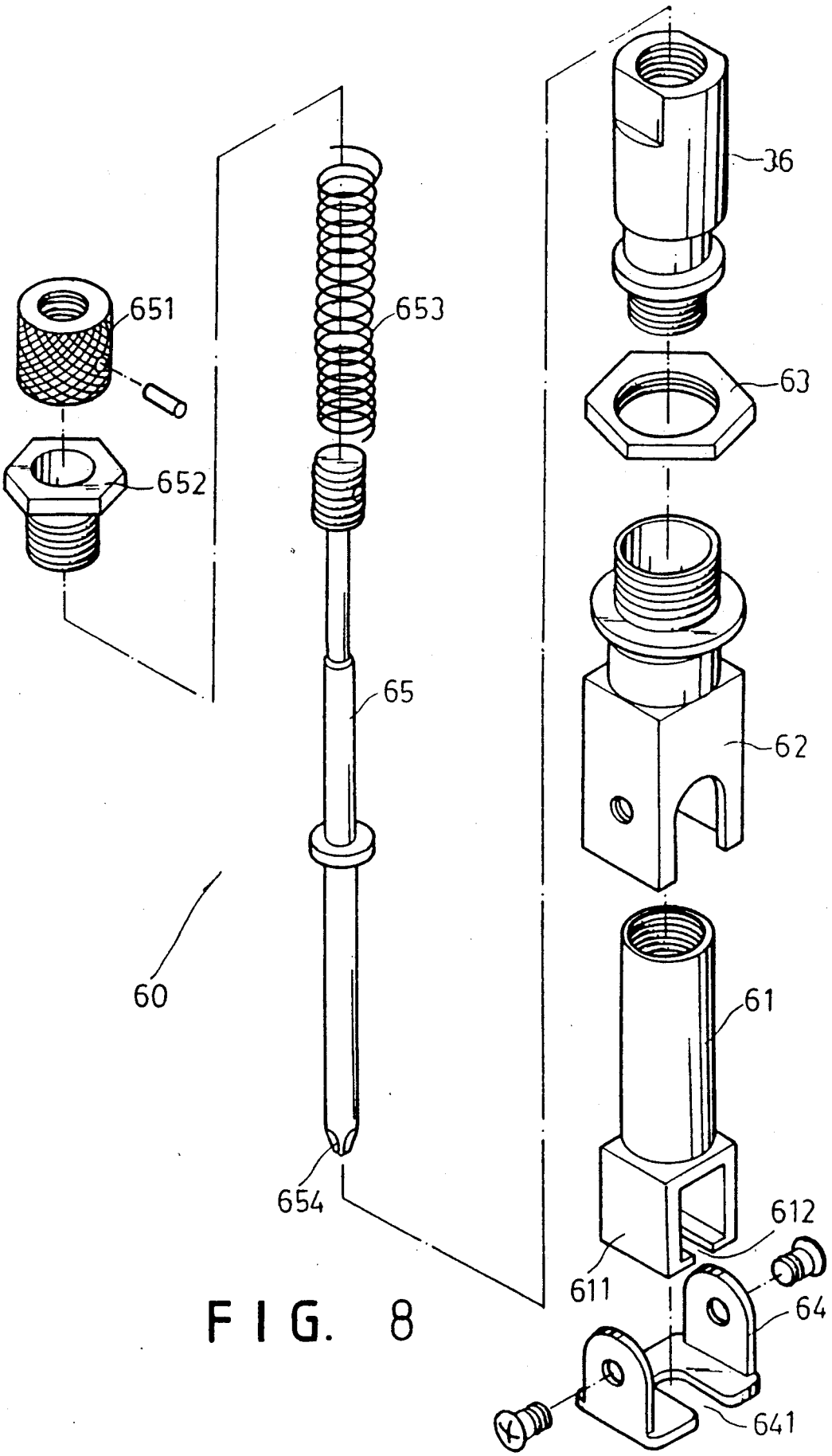
FIG. 8 shows a three-dimensional view of a disassembled anchor riveting apparatus according to the present invention.
Figure 11:
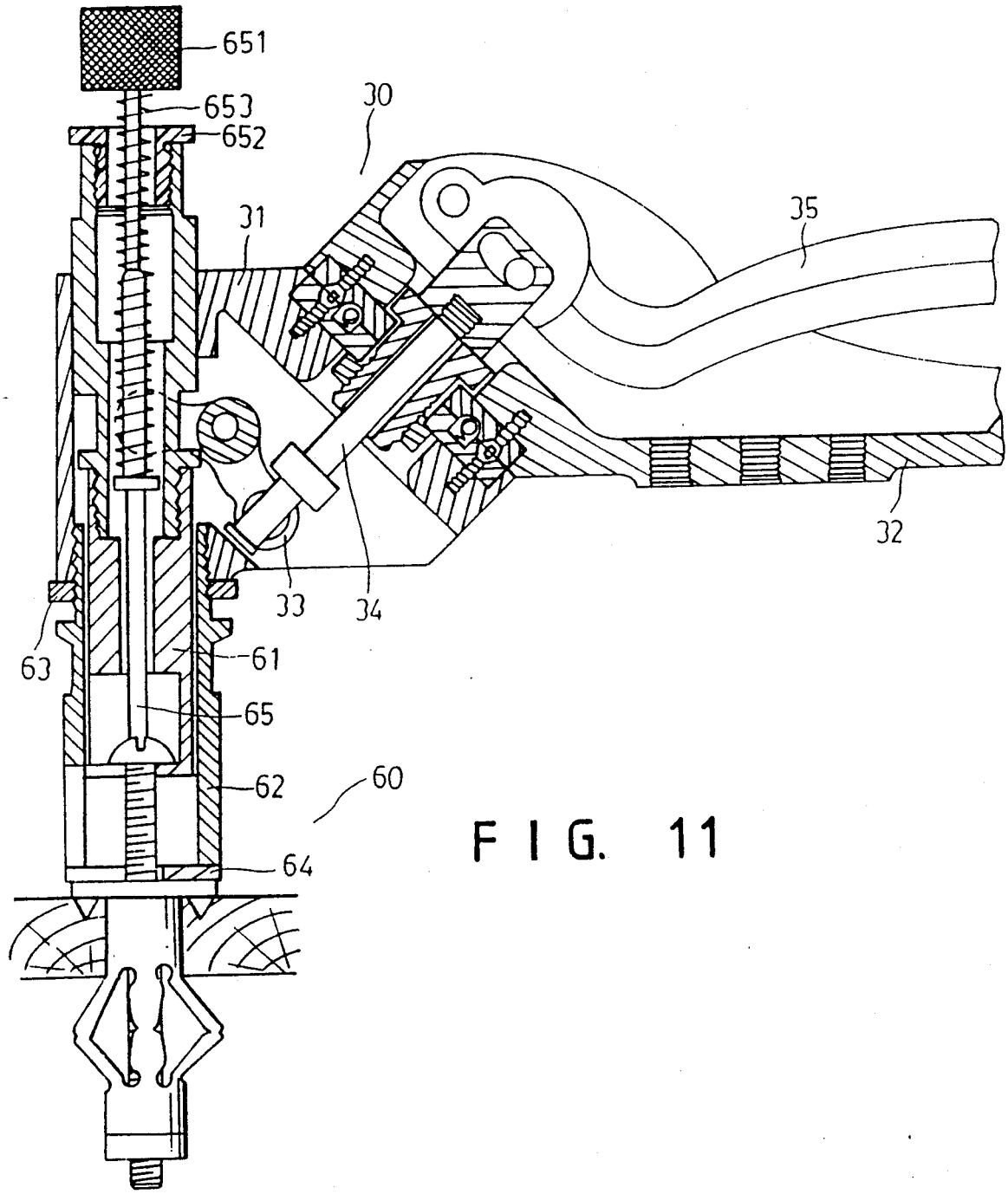
FIG. 11 shows a view of an anchor riveting apparatus in action.

In the same manner, a rivet-pulling apparatus 40 or a nut-pulling apparatus 50 can be dislodged and replaced with an anchor riveting apparatus 60, as shown in FIGS. 7 and 8. The anchor riveting apparatus 60 consist of a pull tube 61 attached to the base of the sleeve 36. The base of the pull tube 61 constitutes a square pull block 611 which has a U-shaped slot 612 located at front end thereof. The body head 31 is fastened to an outer sleeve head 62 extending to the outside thereof. The pull block 611 can slide, but not rotate, upward and downward inside the outer sleeve head 62. Located between the sleeve 36 and the outer sleeve head 62 is a set screw nut 63 which is used to set the position of the outer sleeve head 62. The outer sleeve head 62 is designed in such a way that it can fit into the stopper block 64 having a U-shaped groove or slot 641. At the upper end of the recovery rod 65 is a press head 651. Disposed at the mid-section of the recovery rod 65 are a screw nut 652 and a coiled spring 653. The base end portion of the recovery rod 65 is formed in the cross-sectional shape of a tapered cross 654. The recovery rod 65 is fastened to the sleeve 36 by means of a screw nut 652. Since the screw rod of an anchor rivet is placed across the U-shaped slot 612 and the cross-sectionally shaped tapered cross 654 is aimed at the head of screw rod of an anchor rivet, the press-down of the press handle 35 will cause the pull tube 61 to move backward, resulting in a backward movement as well as an expansion of an anchor rivet, as shown in FIG. 11. As soon as press handle 35 is released, the pull tube 61 returns to its initial position. Furthermore, it is feasible to make use of the recovery rod 65 to adjust the position of the screw rod in preparation for an another attempt. Therefore, the present invention has advantages over the conventional tool of the same category in terms of speed and convenience.

The embodiment of the present invention incorporates three different and separate hand tools into one which has the features of economy, structural simplicity and novelty, and ease of use.

I claim:

1. A multi-functional riveter having a hollow body head with an extended hand grip, said hollow body head having therein a hinged lever, one end of said lever being fastened to a transmission shaft, said transmission shaft being coupled to a hinged press handle extending external said hollow body head of the riveter to provide an activating force; the other end of said lever being connected to a sleeve, said sleeve comprising means for providing a rivet-pulling apparatus, a nut-pulling apparatus, or an anchor riveting apparatus to be used interchangeably as desired, and wherein said rivet-pulling apparatus comprises a rivet holding tube adapted to be to a lower end of said sleeve, said rivet holding tube has two conical blocks, one press block, and one coiled spring disposed in that order therein, an outer sleeve head surrounding said holding tube and adapted to be attached to said hollow body head at a base end thereof, said outer sleeve head being secured to a fixed screw nut threadedly secured thereto and a sleeve ear threadedly secured to said fixed screw nut, said rivet holding tube adapted to be linearly displaced by said sleeve for pulling a rivet by an activating force derived from the press handle which is concurrently displaced;

wherein said nut-pulling apparatus comprises a pulling rod adapted to be located within said sleeve, an upper end portion of said pulling rod constituting a press head which is rotatably located within an outer screw tube adapted to be threadedly secured to an upper end of said said sleeve, a lower end of said pulling rod constituting an outer screw thread; said body head being secured to an outer sleeve head, said outer sleeve head being threadedly secured to an adjustable screw having a set screw nut mounted thereon, said pulling rod being displaced responsive to a displacement of said press handle thereby to force a pulling nut adapted to be threadedly secured to said pulling rod to be firmly attached to a metal lamella;

wherein said anchor riveting apparatus comprises a pull tube adapted to be attached to a base of said sleeve, a base of a said pull tube constituting a square pull block which has a U-shaped slot formed through a frontal end therefore; an outer sleeve head adapted to be attached to said hollow body head, said outer sleeve head extending externally of said hollow body head, said pull block being slideably displaceable within said outer sleeve head, a set screw nut is secured between the hollow body head and said outer sleeve head, said set screw nut being used to determine the position of said outer sleeve head with respect to stopper block having a U-shaped slot, said recovery rod adapted to extend through said sleeve and extending through said outer sleeve head and said pull tube, a press head being secured to an upper end of the recovery rod, a screw nut and a coiled spring being disposed at a mid-section of the recovery rod, said recovery rod having a base end formed in a cross-sectional shape of a tapered cross, said pull tube being displaced resonsive to a displacement of said sleeve by said press handle, resulting in a displacement and expansion of an anchor rivet, wherein said cross-sectional shaped tapered cross of said recovery rod is adapted for contiguously interfacing with and rotationally adjusting the position of a screw rod of an anchor rivet; and said construction of the multi-functional riveter being used interchangeably with said rivet-pulling apparatus, said nut-pulling apparatus, and said anchor riveting apparatus.

* * * * *